United States Patent [19]

Allen

[11] Patent Number: 4,833,580

[45] Date of Patent: May 23, 1989

[54] ILLUMINATED DECORATIVE ORNAMENT

[76] Inventor: Sheril L. Allen, 102 Richbourg Rd., Greenville, S.C. 29615

[21] Appl. No.: 253,394

[22] Filed: Oct. 3, 1988

Related U.S. Application Data

[63] Continuation of Ser. No. 47,418, May 6, 1987, abandoned.

[51] Int. Cl.[4] ..... F21V 3/02

[52] U.S. Cl. ..... 362/451; 362/351; 362/806

[58] Field of Search ..... 362/122, 124, 357, 451, 362/806, 807, 808, 433

[56] References Cited

U.S. PATENT DOCUMENTS

| | | | |
|---|---|---|---|
| 192,153 | 6/1877 | Clark et al. | 362/433 |
| 732,806 | 7/1903 | Wolfert | 362/806 X |
| 764,207 | 7/1904 | Robinson | 362/806 X |
| 1,211,771 | 1/1917 | Singer | 362/124 |
| 2,513,565 | 7/1950 | Johnson | 362/808 X |
| 2,815,439 | 12/1957 | Plubell | 362/806 X |
| 3,694,648 | 9/1972 | Yates | 362/808 X |
| 4,452,836 | 6/1984 | Daniel | 362/806 X |
| 4,652,980 | 3/1987 | Segan | 362/806 X |
| 4,682,079 | 7/1987 | Sanders et al. | 362/806 X |

FOREIGN PATENT DOCUMENTS

| | | | |
|---|---|---|---|
| 614683 | 5/1935 | Fed. Rep. of Germany | 362/808 |
| 908060 | 4/1946 | France | 362/351 |
| 155955 | 1/1921 | United Kingdom | 362/806 |

*Primary Examiner*—Tony M. Argenbright
*Assistant Examiner*—Eric R. Carlberg
*Attorney, Agent, or Firm*—Bailey & Hardaway

[57] ABSTRACT

An illuminated hollow decorative ornament having support means independent of the associated light source or the support structure of the associated light source.

6 Claims, 2 Drawing Sheets

ILLUMINATED DECORATIVE ORNAMENT

This application is a continuation of application Ser. No. 047,418, filed May 6, 1987, now abandoned.

BACKGROUND OF THE INVENTION

This invention relates generally to the art of illuminated ornaments and more specifically to ornaments which hang on or dangle from a decorated object and are associated with a light source.

Various illuminated ornamental objects exist within the prior art. One such object is disclosed in U.S. Pat. No. 2,095,648 to Oftedahl which specifies an illumination or display device having a cavity with a resilient member for engaging a light bulb or the socket of a light bulb. Disclosed in U.S. Pat. No. 3,050,619 to Abramson is a plurality of translucent floral units removably attached to electric light sockets. U.S. Pat. No. 2,296,746 to Snyder et al discloses an illuminated ornamental object with a colored light bulb mounted in a central opening thereof, and U.S. Pat. No. 2,217,877 to Petry also discloses an illuminated device mounted on a light source. In U.S. Pat. No. 3,873,880 to Riddell, an illuminated ornament with a self-contained power source is disclosed.

In addition, particular designs of ornamental objects exist within the prior art. U.S. Pat. No. Des. 215,304 to Kadmon et al discloses an ornamental design for a plurality of illuminable Christmas decorations, each of which engages a light bulb on a string of lights. U.S. Pat. No. Des. 238,952 to Karkaer et al discloses a design for a festoon, and disclosed in U.S. Pat. No. Des. 216,128 to Adler is the design of a Christmas tree ornament in direct contact with a light bulb using the bulb for support.

Whereas the prior art provides various illuminated ornaments, all such ornaments require, for their own support and display, contact with the light source or the support structure of the light source.

SUMMARY OF THE INVENTION

It is thus an object of this invention to provide a novel illuminated decorative ornament having its own means of support independent from that of the associated power source or the power source itself.

It is a further object of this invention to provide a hollow decorative ornament to be used as a source of diffused light when an appropriate light source is positioned within it.

These as well as other objects are accomplished by an illuminated decorative ornament comprising a translucent housing defining a cavity and having at least one opening therein, ornamentation on the outer surface of the housing, a means for supporting the housing positioned at its outer top surface and a light source arranged within the cavity of the housing such that the housing has no contact with the light source or its support structure.

DETAILED DESCRIPTION OF THE DRAWINGS

In accordance with this invention, it has been found that the illuminated decorative ornament to be herein described may have its own means of support independent from its source of illumination and independent from the support structure for its source of illumination. In preferred forms of the invention, such support means comprises a conventional ornament hook or a loop of thread, ribbon or rickrack attached to the top surface of the ornament itself or to one of the decorative embellishments on its topmost surface. Such means readily supports the hollow ornament of lightweight plastic, glass or other suitable translucent material and allows it to hang or dangle freely without further restrictions. In addition, there is an opening in the bottommost surface of the ornament through which the associated light source is disposed into the ornament's cavity. A similar optional opening may be positioned on the side of the ornament opposite that on which the printed and painted decorations appear. The light source is typically a miniature light bulb as found on conventional strings of Christmas tree lights.

The embodiments of the instant invention are typically ellipsoidal or spherical in shape, or have contoured embellishments which dimensionally enhance them. Selected decoration as, for example, facial detail or works and/or designs, is printed and painted on the blank housing, and further decorative embellishments, as, for example, hats, collars, synthetic hair, ribbons and/or lace may be added. In preferred forms of the invention the resulting ornament typically comprises the head of a person or animal; in other preferred forms of the instant invention the embodiment is purely ornamental, displaying slogans and/or designs.

Figure 1:
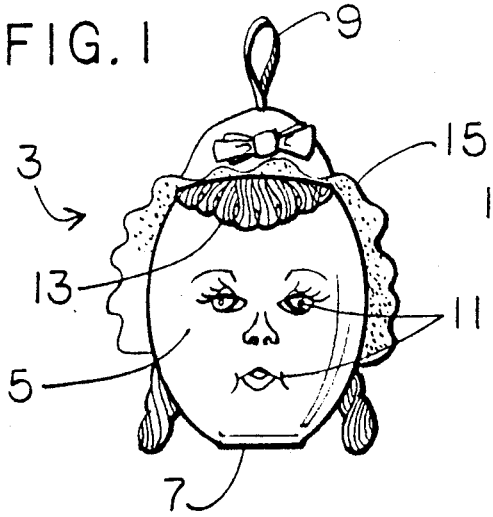
FIG. 1 of the drawings is a front elevational view of an ellipsoidal ornament in accordance with the invention.
Figure 2:
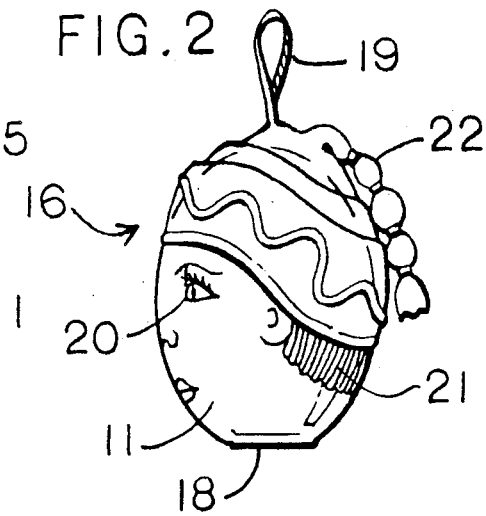
FIG. 2 of the drawings is a side elevational view of an ellipsoidal ornament in accordance with the invention.

FIG. 1 of the drawing illustrates a front elevational view of an ellipsoidal ornament 3 in accordance with the invention depicting a person's head, including a translucent housing 5, a cavity (not depicted), an opening 7 at the bottommost surface of housing 5, support means 9 comprising a loop of thread attached, preferably with glue, to housing 5, and various embellishments, including printed and/or painted facial detail 11, synthetic hair 13, and bonnet 15. FIG. 2 of the drawings is a side elevational view of a second ellipsoidal ornament 1 in accordance with the invention displaying variations of the features illustrated in FIG. 1, including housing 17, opening 18 at the bottommost surface of housing 17, support means 19, printed and/or painted facial detail 20, printed and/or painted hair 21 and cap 22 with tassel.

Figure 3:
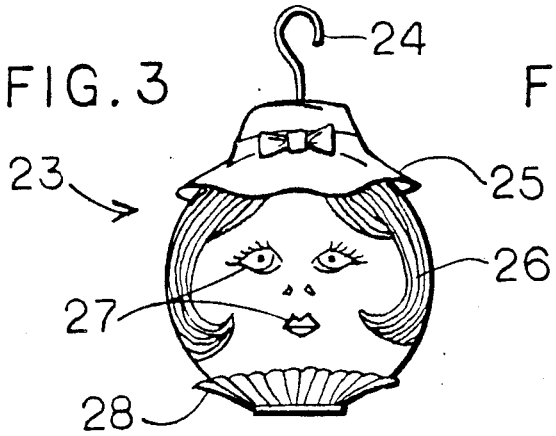
FIG. 3 of the drawings is a front elevational view of a spherical ornament in accordance with the invention.
Figure 4:
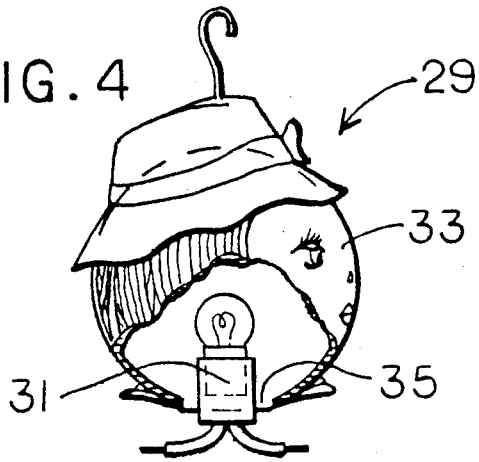
FIG. 4 of the drawings is a side elevational view of the spherical ornament of FIG. 3 in accordance with the invention.

In FIG. 3 of the drawings, a front elevational view of a spherical ornament 23 is illustrated. In this embodiment of the instant invention, means of support 24 is a hook attached to decorative embellishment 25, a hat. Painted or synthetic hair 26, facial detail 27 and collar 28 are indicated. FIG. 4 of the drawings illustrates spherical ornament 29 in accordance with the invention, a variation of the ornament 23 shown in FIG. 3, illustrating, particularly, light source 31 disposed within the cavity of housing 33 through opening 35.

Figure 5:
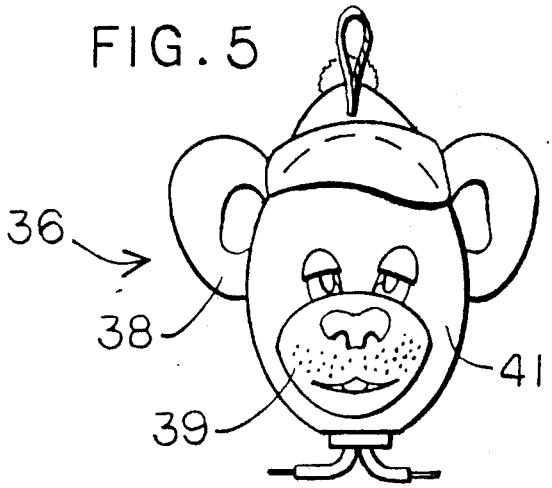
FIG. 5 of the drawings is a front elevational view of a generally ellipsoidal ornament having contoured embellishments in accordance with the invention.
Figure 6:
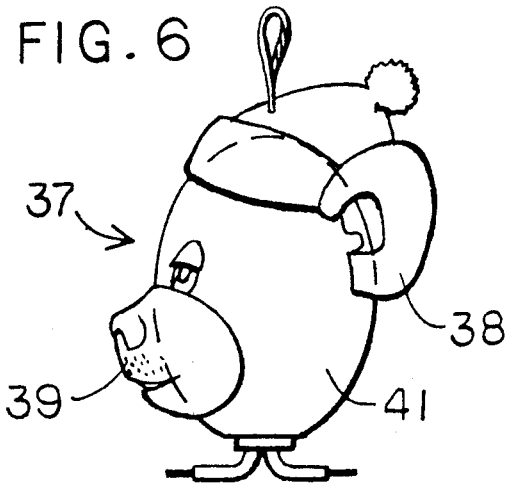
FIG. 6 of the drawings is a side elevational view of the ornament of FIG. 5 having contoured embellishments in accordance with the invention.

FIGS. 5 and 6 of the drawings illustrate heads of bears 36 and 37 as embodiments of the instant invention. Similar features to those shown in FIGS. 1–4 are evident. In addition, contoured embellishments 38 and 39 are illustrated which dimensionally enhance housings 41 and 43 respectively.

Figure 7:
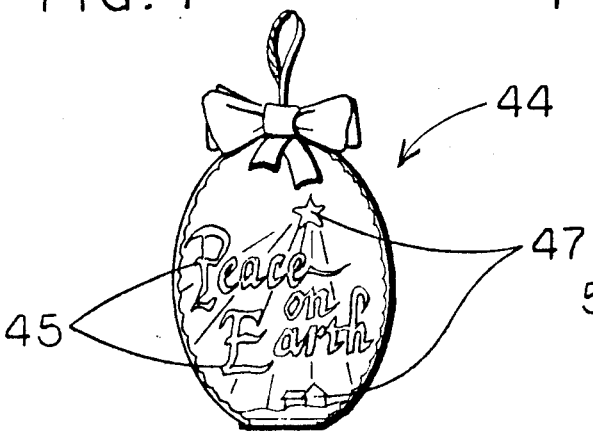
FIG. 7 of the drawings is a front elevational view of an ellipsoidal ornament in accordance with the invention.
Figure 8:
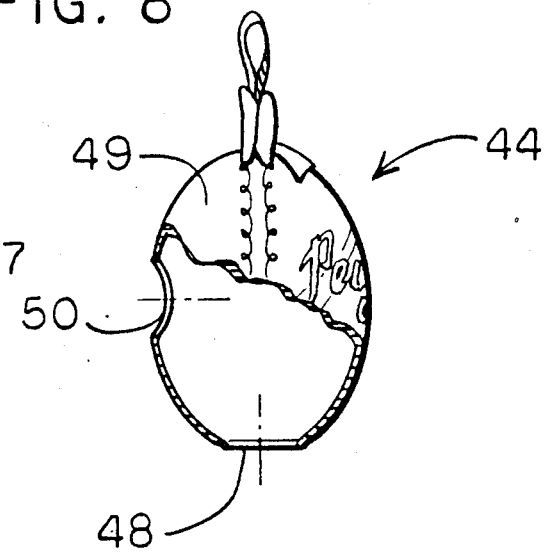
FIG. 8 of the drawings in a side elevational view of the ornament of FIG. 7 in accordance with the invention.

Illustrated in FIGS. 7 and 8 of the drawings in accordance with the invention is a front elevational view and a side elevational view, respectively, of the same ellipsoidal ornament 44, another embodiment of the instant invention. Ornament 44 displays slogan 45 and designs 47 in conjunction with selected previously described features. In FIG. 8, addition to opening 48 at the bottom of housing 49, optional opening 50 is shown on the back surface of ornament 44, opening 50 may be applicable to various embodiments of this invention.

Figure 9:
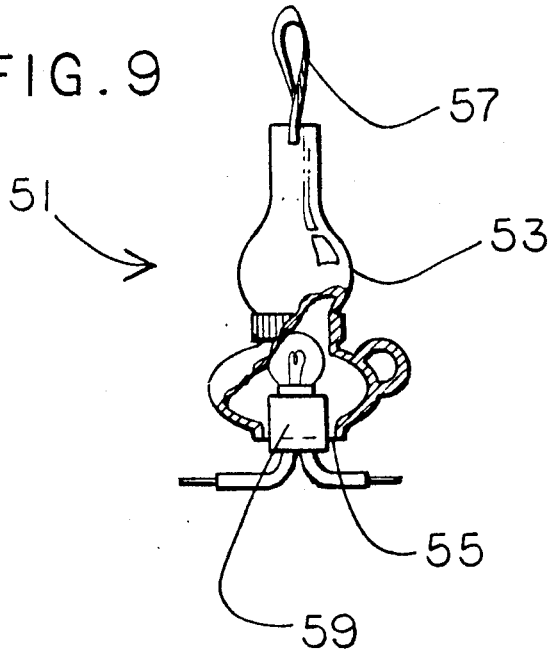
FIG. 9 of the drawings is a front elevational view of a contoured ornament in accordance with the invention.

FIG. 9 of the drawings illustrates a front elevational view of an additional embodiment 51 of the instant invention, including housing 53, opening 55, means for support 57, and associated light source 59.

The embodiments of the instant invention are appropriate ornaments for a Christmas tree. A string of lights, typically having miniature light bulbs, is draped in the usual fashion around the tree. Each ornament is then secured to the tree by its hook or loop, and hangs freely over and around an individual light bulb which is disposed in the cavity of the ornament through the opening provided. There is no contact between the suspended ornament and bulb or between the ornament and the bulb's support structure.

Each suspended decorative ornament becomes a source of diffused light which radiates a soft glow from its position on the lighted Christmas tree. The effect is unique and charming and a delightful touch for a festive occasion.

Whereas the above description pertains primarily to ornaments on a Christmas tree, variations of both the instant invention and the uses therefor will be apparent to one of skill in the art from a reading of the above specifications. Such variations are within the spirit and scope of this invention as defined by the following appended claims:

That which is claimed is:

1. An illuminated decorative ornament comprising:
   - a translucent housing defining a cavity and having at least one opening therein;
   - ornamentation means on the outer surface of said housing;
   - means for supporting said housing positioned at the outer top surface thereof;
   - an opening defined in a bottommost surface of said housing;
   - a light source pushed upwardly through said opening, arranged within said cavity of said housing, said housing having no connection with said light source or the support structure of said light source; and
   - a separate support for said light source separate and independent from said means for support of said housing.

2. The illuminated decorative ornament in accordance with claim 1 wherein said housing is generally ellipsoidal or spherical in shape and is constructed of plastic, glass or other suitable light-transmittive material.

3. The illuminated decorative ornament in accordance with claim 1 wherein said ornamentation on the outer surface of said housing includes, at least one of printed and painted words, designs, and particularly facial detail; ribbon, lace, synthetic hair, hats, bonnets, collars, or contoured embellishments.

4. The illuminated decorative ornament in accordance with claim 1 wherein said ornament is used as a source of diffused light for decorative purposes.

5. The illumination decorative ornament in accordance with claim 3 wherein said housing includes a second opening in a back side surface thereof opposite a side having said ornamentation thereon.

6. A decorative article comprising:
   - a plurality of translucent housing, each defining a cavity and having at least one opening in a bottommost surface thereof supported from said article;
   - ornamentation of the outer surface of said housing;
   - means for supporting said housing positioned on the outer top surface thereof; and
   - a plurality of light sources independently supported on said article and strung one to the other with individual light sources pushed upwardly through said opening and positioned within the cavity of said translucent housing defining means.

* * * * *